US008817448B1

(12) United States Patent
Maurer

(10) Patent No.: US 8,817,448 B1
(45) Date of Patent: Aug. 26, 2014

(54) STATIC DISSIPATING ASSEMBLY

(76) Inventor: Eric R. Maurer, Hot, MO (US)

( * ) Notice: Subject to any disclaimer, the term of this patent is extended or adjusted under 35 U.S.C. 154(b) by 128 days.

(21) Appl. No.: 13/597,913

(22) Filed: Aug. 29, 2012

(51) Int. Cl.
*H05F 3/02* (2006.01)

(52) U.S. Cl.
USPC ..... 361/215

(58) Field of Classification Search
CPC ..... B67D 7/3236; H05F 3/02; F16L 35/005; Y10S 57/901
USPC ..... 361/215
See application file for complete search history.

(56) References Cited

U.S. PATENT DOCUMENTS 3,857,397 A * 12/1974 Brosseau ..... 607/149
4,577,256 A * 3/1986 Breidegam ..... 361/220
4,667,521 A 5/1987 Fuss et al.
4,698,724 A * 10/1987 Burvee ..... 361/220
4,847,729 A 7/1989 Hee
D313,392 S 1/1991 Sachs
5,159,523 A * 10/1992 Claassen et al. ..... 361/215
5,898,560 A 4/1999 Flaynik, Jr. et al.
6,283,320 B1 * 9/2001 Patch ..... 220/88.1
6,735,070 B2 5/2004 Antila
6,823,903 B2 11/2004 Davis

* cited by examiner

*Primary Examiner* — Scott Bauer

(57) ABSTRACT

A static dissipating assembly dissipates static from a vehicle to prevent accidental ignition of flammable fumes while replenishing a fuel supply for a vehicle. The assembly includes a conductive strap having a first end and a second end. A first connector is coupled to the first end of the strap. The first connector is configured for coupling to a fuel dispensing nozzle. A second connector is coupled to the second end of the strap. The second connector is configured for coupling to a vehicle proximate a fuel port of the vehicle.

10 Claims, 5 Drawing Sheets

STATIC DISSIPATING ASSEMBLY

BACKGROUND OF THE DISCLOSURE

Field of the Disclosure

The disclosure relates to static dissipating devices and more particularly pertains to a new static dissipating device for dissipating static from a vehicle to prevent accidental ignition of flammable fumes while replenishing a fuel supply for a vehicle.

SUMMARY OF THE DISCLOSURE

An embodiment of the disclosure meets the needs presented above by generally comprising a conductive strap having a first end and a second end. A first connector is coupled to the first end of the strap. The first connector is configured for coupling to a fuel dispensing nozzle. A second connector is coupled to the second end of the strap. The second connector is configured for coupling to a vehicle proximate a fuel port of the vehicle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
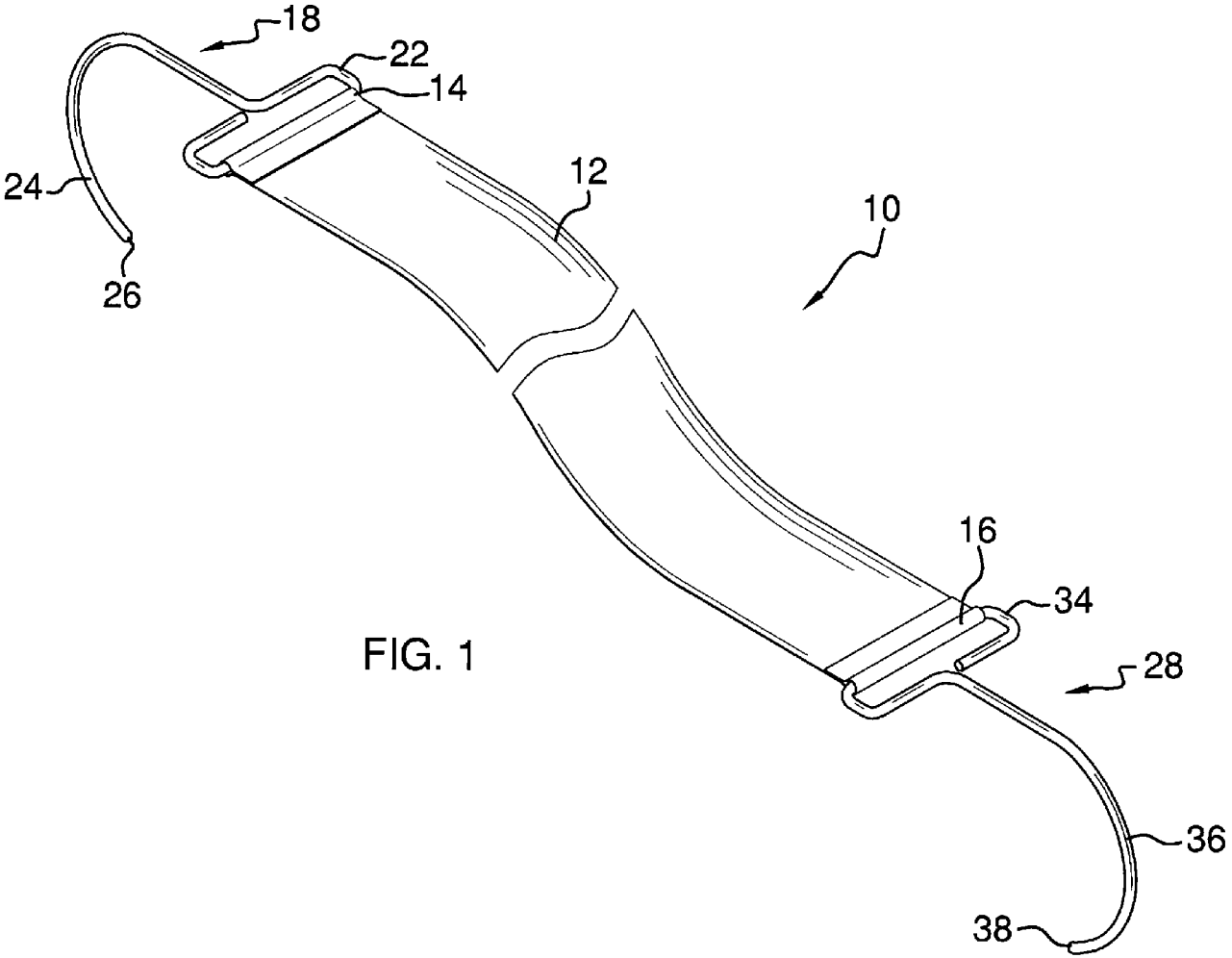
FIG. 1 is a top front side perspective view of a static dissipating assembly according to an embodiment of the disclosure.
Figure 2:
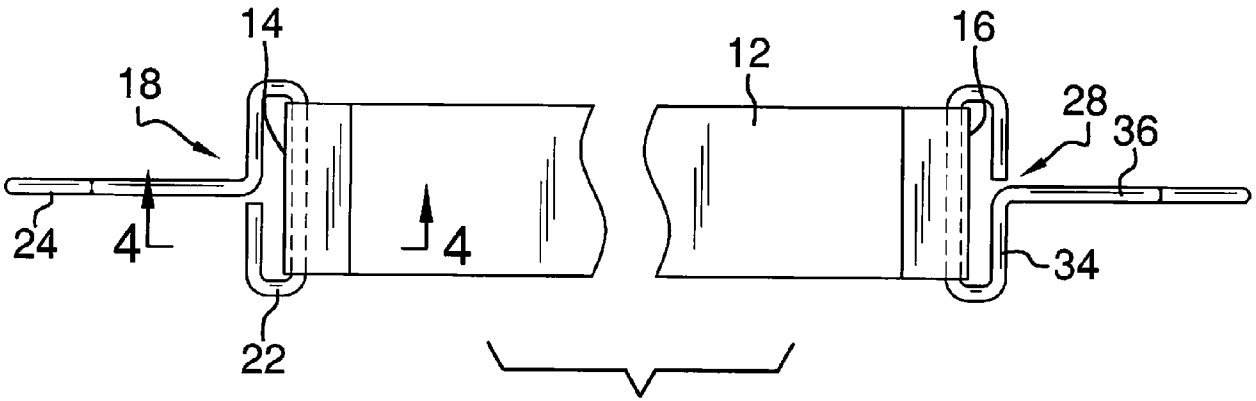
FIG. 2 is a top view of an embodiment of the disclosure.
Figure 3:
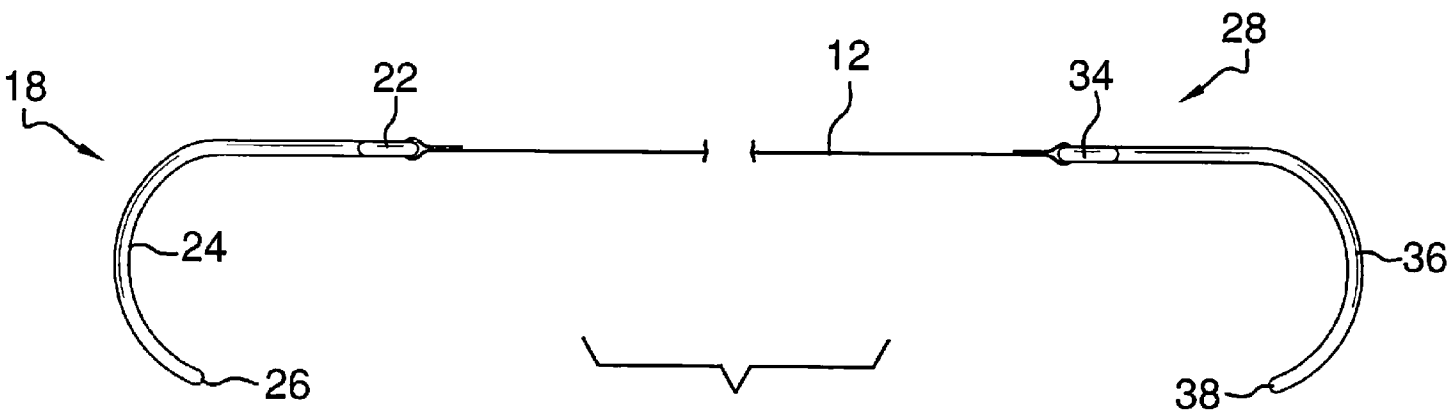
FIG. 3 is a side view of an embodiment of the disclosure.
Figure 4:
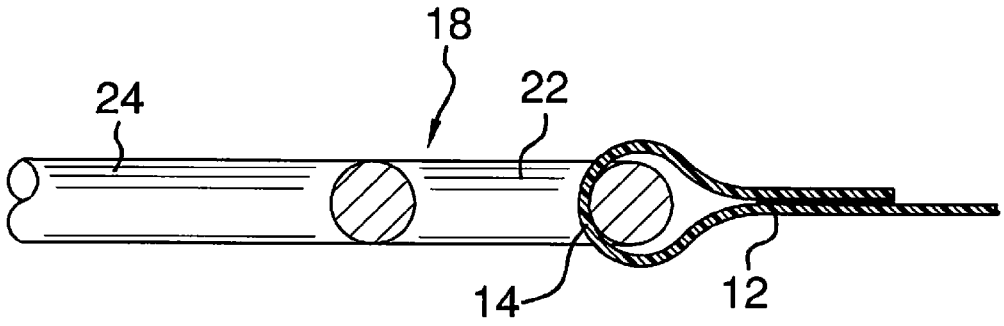
FIG. 4 is a cross-sectional view of an embodiment of the disclosure taken along line 4-4 of FIG. 2.
Figure 5:
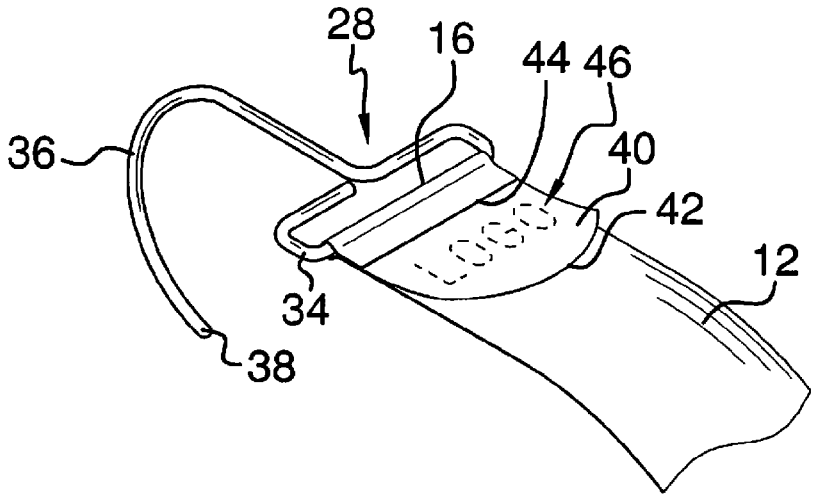
FIG. 5 is a top front side perspective view of an embodiment of the disclosure.
Figure 6:
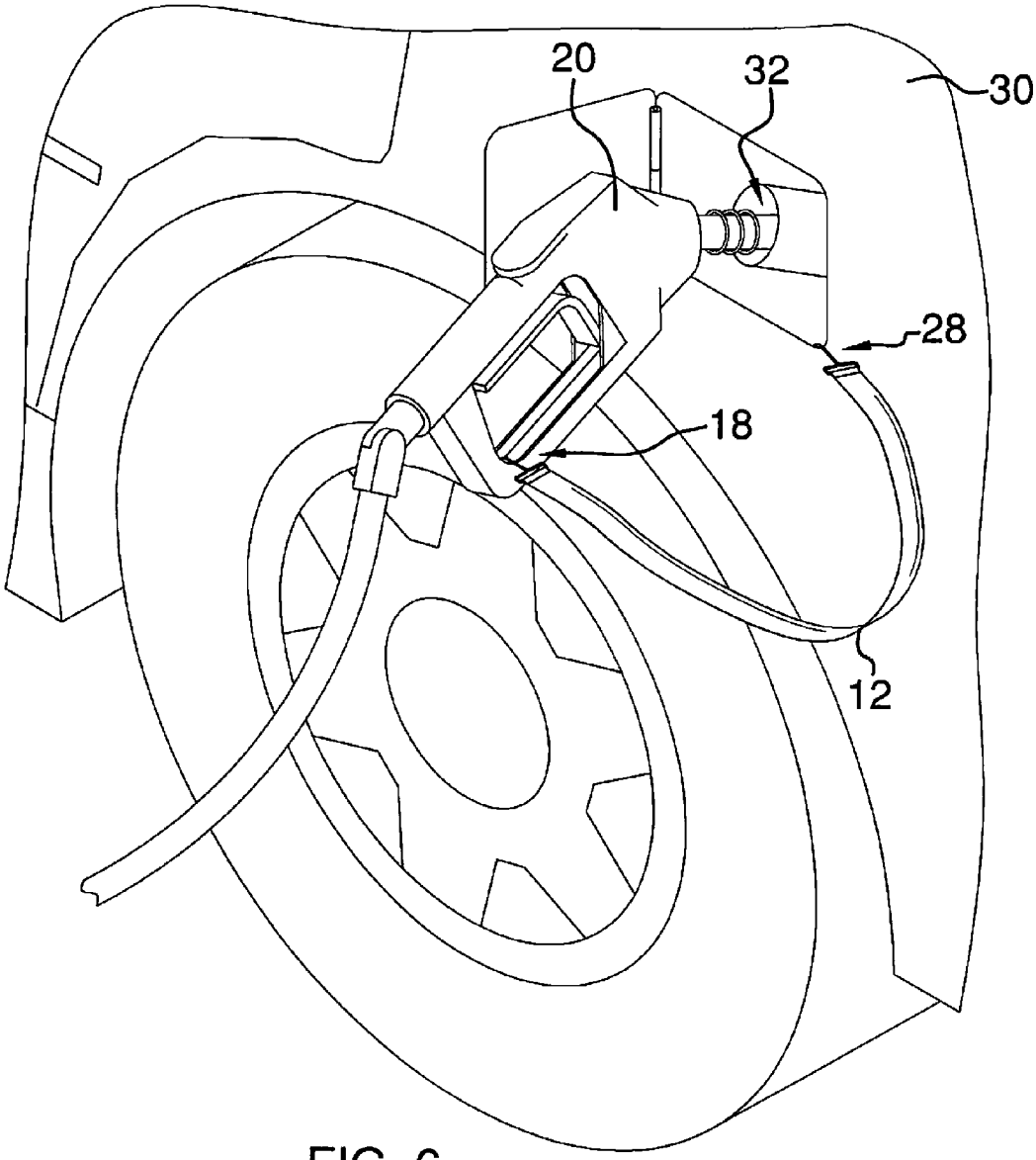
FIG. 6 is a top front side perspective view of an embodiment of the disclosure in use.
Figure 7:
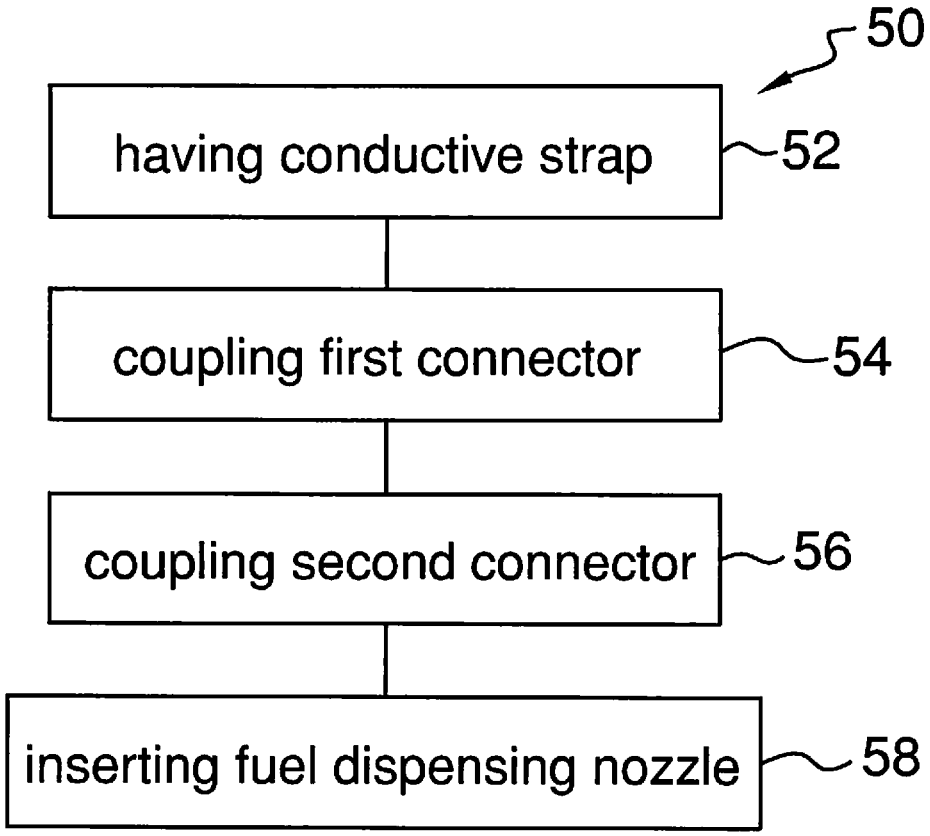
FIG. 7 is a schematic view of a method according to an embodiment of the disclosure.

With reference now to the drawings, and in particular to FIGS. 1 through 7 thereof, a new static dissipating device embodying the principles and concepts of an embodiment of the disclosure and generally designated by the reference numeral 10 will be described.

As best illustrated in FIGS. 1 through 7, the static dissipating assembly 10 generally comprises a conductive strap 12. The strap 12 has a first end 14 and a second end 16. The strap 12 is constructed of a conductive plastic. A first connector 18 is coupled to the first end 14 of the strap 12. The first connector 18 is configured for coupling to a fuel dispensing nozzle 20. The first connector 18 may be constructed of metal or another conductive material and comprise a loop section 22 coupled to the first end 16 of the strap 12. The first connector 18 further has a hook section 24 coupled to and extending from the loop section 22 of the first connector 18. The loop section 18 may lie in a plane perpendicular to a plane in which the hook section 24 lies. Thus, a free end 26 of the hook section 24 is offset from the loop section 18 to facilitate engaging the hook section 24 to the fuel dispensing nozzle 20.

A second connector 28 is coupled to the second end 16 of the strap 12. The second connector 28 is configured for coupling to a vehicle 30 proximate a fuel port 32 of the vehicle 30. The strap 12 may provide sufficient length such that the second end 16 is sufficiently spaced from the fuel port 32 to reduce the risk of ignition of fuel fumes emanating from the fuel port 32. The second connector 28 may be constructed of metal or another conductive material. The second connector 28 comprises a loop section 34 coupled to the second end 16 of the strap 12. The second connector 28 further includes a hook section 36 coupled to and extending from the loop section 34 of the second connector 28. Similar to the first connector 18, the loop section 34 may lie in a plane perpendicular to a plane in which the hook section 36 lies. Thus, a free end 38 of the hook section 36 is offset from the loop section 34 to facilitate engaging the hook section 36 to the vehicle 30.

A tab 40 may be provided extending from either the first end 14 or the second end 16 of the strap 12. The tab 40 may have an arcuate distal edge 42 and a coupled edge 44 adjacent to the first end 14 or second end 16 from which the tab 40 extends. Indicia 46 may be positioned on the tab 40 to display an advertising message or the like.

In use, the assembly 10 provides for a method 50 of dissipating static charge while refilling a vehicle fuel tank. A step 52 of the method 50 is having the conductive plastic strap 12, a first metal connector 18 being coupled to the first end 14 of said strap 12, and the second metal connector 28 being coupled to the second end 16 of said strap 12. Another step 54 is coupling the first connector 18 to the fuel dispensing nozzle 20. Another step 56 is coupling the second connector 28 to a metal section of the vehicle 30 wherein static is dissipated across the strap 12. A final step 58 is inserting the fuel dispensing nozzle 30 into the fuel port 32 leading into the vehicle fuel tank.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A static dissipating assembly comprising:

a conductive strap, said strap comprising a first end and a second end;

a first connector coupled to said first end of said strap, said first connector being configured for coupling to a fuel dispensing nozzle, said first connector comprising a hook section being configured to be removably engaged to the dispensing nozzle;

a second connector coupled to said second end of said strap, said second connector being configured for coupling to a vehicle proximate a fuel port of the vehicle, said second connector comprising a hook section being configured to be removably engaged to the vehicle.

2. The assembly of claim 1, further comprising said strap being constructed of a conductive plastic.

3. The assembly of claim 1, further comprising said first connector being constructed of metal.

4. The assembly of claim 1, further comprising said second connector being constructed of metal.

5. The assembly of claim 1, further comprising said first connector comprising a loop section coupled to said first end of said strap, said first connector comprising said hook section coupled to and extending from said loop section of said first connector.

6. The assembly of claim 1, further comprising said second connector comprising a loop section coupled to said second end of said strap, said second connector comprising said hook section coupled to and extending from said loop section of said second connector.

7. The assembly of claim 1, further comprising:

a tab extending from said second end of said strap; and indicia positioned on said tab.

8. A static dissipating assembly comprising:

a conductive strap, said strap having a first end and a second end, said strap being constructed of a conductive plastic;

a first connector coupled to said first end of said strap, said first connector being configured for coupling to a fuel dispensing nozzle, said first connector being constructed of metal, said first connector comprising a loop section coupled to said first end of said strap, said first connector comprising a hook section coupled to and extending from said loop section of said first connector;

a second connector coupled to said second end of said strap, said second connector being configured for coupling to a vehicle proximate a fuel port of the vehicle, said second connector being constructed of metal, said second connector comprising a loop section coupled to said second end of said strap, said second connector comprising a hook section coupled to and extending from said loop section of said second connector;

a tab extending from said second end of said strap; and indicia positioned on said tab.

9. A method of dissipating static charge while refilling a vehicle fuel tank, the steps of the method comprising:

providing a conductive plastic strap, a first metal connector being coupled to a first end of said strap, a second metal connector being coupled to a second end of said strap;

coupling said first connector to a fuel dispensing nozzle; and coupling said second connector to a metal section of a vehicle wherein static is dissipated across said strap, said first and second connectors each comprising a hook.

10. The method of claim 9, the steps of the method further comprising inserting said fuel dispensing nozzle into a fuel port into the vehicle fuel tank.

* * * * *